US007009617B2

(12) United States Patent
Kotani et al.

(10) Patent No.: US 7,009,617 B2
(45) Date of Patent: Mar. 7, 2006

(54) ON-SCREEN DISPLAY DEVICE

(75) Inventors: Satoru Kotani, Hirakata (JP); Toshihiko Maruoka, Ikeda (JP); Keisuke Tanaka, Toyonaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/814,191

(22) Filed: Apr. 1, 2004

(65) Prior Publication Data

US 2005/0134596 A1 Jun. 23, 2005

(30) Foreign Application Priority Data

Apr. 1, 2003 (JP) ..... 2003-097541

(51) Int. Cl.
*G09G 5/22* (2006.01)

(52) U.S. Cl. ..... 345/551; 345/467; 345/581; 348/564; 348/569

(58) Field of Classification Search ..... 345/501, 345/530, 551, 545, 564, 581, 467–470; 348/569, 348/563, 564, 567
See application file for complete search history.

(56) References Cited

U.S. PATENT DOCUMENTS 4,763,118 A * 8/1988 Takai ..... 345/467
5,153,575 A * 10/1992 Watts et al. ..... 345/87
5,251,293 A * 10/1993 Ishii et al. ..... 715/542
5,623,316 A * 4/1997 Naito et al. ..... 348/569
5,712,663 A * 1/1998 Matsumoto ..... 345/471
6,281,876 B1 * 8/2001 Jones, Jr. ..... 345/467

FOREIGN PATENT DOCUMENTS

JP 9-54575 2/1997
JP 11-102352 4/1999

* cited by examiner

*Primary Examiner*—Kee M. Tung
(74) *Attorney, Agent, or Firm*—Wenderoth, Lind & Ponack, L.L.P.

(57) ABSTRACT

An on-screen display device that can effectively utilize a video RAM area. This on-screen display device includes a video RAM that holds character data of desired characters that are to be displayed; a display character setting unit for locating the number of bits as many as the remainder that is obtained by dividing character data corresponding to one character by the number of bits that can be read at one-time access from the video RAM, collectively by one line in the video RAM; buffers for storing a part of character data of the respective characters; a character generator ROM for outputting font data corresponding to the character codes; and a display control unit for reading character data from the video RAM via the buffers at the display of the characters, and reading the font data that are created by the character generator ROM, thereby outputting an on-screen output signal.

8 Claims, 8 Drawing Sheets

ON-SCREEN DISPLAY DEVICE

FIELD OF THE INVENTION

The present invention relates to on-screen display devices that display desired characters.

BACKGROUND OF THE INVENTION

Televisions or videocassette recorders are provided with an on-screen function of displaying information that indicates the state of the device, such as the channel or the programming of recording, on the television screen.

Initially, a conventional on-screen display device will be described with reference to FIGS. 9(*a*) and 9(*b*). FIG. 9(*a*) is a diagram illustrating a structure of the conventional on-screen display device.

In FIG. 9(*a*), a display character setting unit 100 writes character data that comprise a character code of a desired character to be displayed (hereinafter, referred to as display character) and an attribute code that indicates modification information such as the color of the display character or the background thereof, at a predetermined position in a video RAM 200.

The video RAM 200 has addresses corresponding to respective positions on the display on which the display characters are displayed. FIG. 9(*b*) shows an address map of the conventional video RAM 200. On one screen of the display, 12 lines of 24 characters can be displayed. In addition, the character data is composed of 9 bits, 8 bits of which are a character code indicating up to 256 types of characters, and 1 bit of which is an attribute code.

A display control unit 300 reads character data from the video RAM 200 before starting to display characters of desired positions and outputs the character data to the buffer 500. In addition, the display control unit 300 reads font data corresponding to the character code included in the character data that is read from the buffer 500, from a character generator ROM 400, and generates an on-screen output signal using the font data.

In the character generator ROM 400, plural kinds of font data are stored.

In the buffer 500, the character data that are read from the video RAM 200 are stored.

The operation of the on-screen display device that is constructed as described above will be described.

First, the display character setting unit 100 writes character data corresponding to one screen, which comprise character codes and attribute codes of characters to be displayed, at addresses in the video RAM 200 corresponding to positions on the display at which the characters are to be displayed, as indicated by the address map of the video RAM in FIG. 9(*b*).

Then, the display control unit 300 reads the character data that have been written in the video RAM 200 at a predetermined timing, and stores the data in the buffer 500. Thereafter, the display control unit 300 reads font data stored at addresses that are indicated by the character codes included in the character data outputted from the buffer 500, from the character generator ROM 400. Then, the display control unit 300 outputs an on-screen output signal on the basis of the font data read from the character generator ROM 400 and the attribute codes included in the character data that are read from the video RAM 200.

In this way, characters to which desired character modification has been performed can be displayed on the display. In order to further add the character modification (coloring of the display character itself, the color of the background, and the like), details of the character modification are previously stored in the video RAM 200 (see Japanese Published Patent Application No. Hei.9-54575).

In the conventional on-screen display device, however, when the bit length of character data is larger than the bit length of data in the RAM that is accessed, an empty space is generated in an area of the video RAM for holding the character data, and accordingly the video RAM area cannot be used effectively.

Particularly in a case of utilizing the video RAM area also as the RAM area of the CPU (see Japanese Published Patent Application No. Hei.11-102352), the video RAM area would not be used although it is capable of storing data. More specifically, when the bit length of data that is accessed in the RAM of the CPU is 8 bits and the character data is composed of 9 bits as shown in FIG. 9(*b*), 7 bits in an address for storing the attribute code are not employed.

SUMMARY OF THE INVENTION

The present invention has for its object to provide an on-screen display that can effectively utilize the video RAM area even when the bit length of character data is different from the bit length of data that is accessed in the RAM of the CPU.

Other objects and advantages of the invention will become apparent from the detailed description that follows. The detailed description and specific embodiments described are provided only for illustration since various additions and modifications within the spirit and scope of the invention will be apparent to those of skill in the art from the detailed description.

According to a 1st aspect of the present invention, there is provided an on-screen display device for displaying desired characters on a display, character data of one character being composed of R bits (R is an integer that is equal to or larger than 2), and the character data comprising character codes that indicate types of the characters, or attribute codes that indicate modification display of the respective characters and character codes that indicate types of the characters, including: a video RAM that holds the character data of the desired characters that are to be displayed on the display; a display character setting unit for writing the character data at predetermined positions in the video RAM; a first buffer that reads r bits ($1 \leqq r < R$) of respective m pieces ($2 \leqq m \leqq M$) of the character data selected from among M pieces ($2 \leqq M$) of the character data corresponding to characters that are displayed on one line, from the video RAM at one-time access, and stores the read data; a second buffer that stores remaining (R−r) bits of the respective m pieces of the character data; a character generator ROM for creating font data corresponding to the character codes included in the character data that are outputted from the first and second buffers; and a display control unit for reading the font data from the character generator ROM and generating a desired on-screen output signal on the basis of the font data. Therefore, even when the bit length of character data is different from the bit length of data that is accessed in the RAM, it is possible to effectively utilize the video RAM area.

According to a 2nd aspect of the present invention, in the on-screen display device of the 1st aspect, the remaining (R−r) bits of the character data that are stored in the second buffer are formed in a size comprising bits as many as a multiple of 8. Therefore, the bit length of the character data becomes equal to the bit length of data that is accessed by the display control unit in the video RAM, thereby increasing the access speed.

According to a 3rd aspect of the present invention, in the on-screen display device of the 1st aspect, the display character setting unit positions r bits of the respective m pieces of the character data selected from among the M pieces of the character data corresponding to characters that are displayed on one line, in an area of the video RAM from which the data can be read at one-time access, thereby to write the r bits of the respective m pieces of the character data in consecutive address areas of the video RAM. Therefore, it is possible to effectively utilize the capacity of the video RAM.

According to a 4th aspect of the present invention, in the on-screen display device of the 1st aspect, the character data that are stored in the first buffer are composed of a part or all of the attribute codes. Therefore, it is possible to effectively utilize the video RAM area.

According to a 5th aspect of the present invention, in the on-screen display device of the 1st aspect, the character data that are stored in the first buffer are composed of only a part of the character codes. Therefore, it is possible to effectively utilize the video RAM area.

According to a 6th aspect of the present invention, in the on-screen display device of the 4th aspect, the attribute codes that are stored in the first buffer are codes indicating two types of attributes, and only the attribute codes indicating the same type of attribute are located in an area of the video RAM from which data can be read at one-time access. Therefore, when there are plural kinds of character modification, it is possible to group the character attribute codes dependent on their types, that is, classify those into, for example, an attribute code indicating inverse modification and an attribute code indicating the color of background, thereby increasing the operability of the character display.

According to a 7th aspect of the present invention, in the on-screen display device of the 5th aspect, as for the part of the character codes that are stored in the first buffer, respective bits of the part of the character codes relating to the same character are located only in an area of the video RAM from which data can be read at one-time access. Therefore, as compared to a case where the data are not located in the same address, it is possible to reduce the number of times of accessing to the video RAM by the display control unit.

According to an 8th aspect of the present invention, there is provided an on-screen display device for displaying desired characters on a display, data of the characters comprising character codes that indicate types of the characters, or attribute codes that indicate modification display of the characters and character codes that indicate types of the characters, including: a video RAM that holds the character data of the desired characters that are to be displayed on the display; a display character setting unit for writing the character data at predetermined positions in the video RAM; a character code buffer for storing the character codes included in the character data that are outputted from the video RAM; an attribute code buffer for storing the attribute codes included in the character data that are outputted from the video RAM; a character generator ROM for creating font data corresponding to the character codes; and a display control unit for reading the character codes included in the character data that are outputted from the video RAM from the character code buffer, and generating a desired on-screen output signal on the basis of the font data that are outputted from the character generator ROM and the attribute codes outputted from the attribute code buffer. Therefore, even when the bit length of character data is different from the bit length of data that is accessed in the RAM, it is possible to effectively utilize the video RAM area.

According to a 9th aspect of the present invention, in the on-screen display device of the 8th aspect, the attribute codes included in the character data that are outputted from the video RAM indicate a start position of application of attributes, and an end position of the application of attributes or the number of characters to which the attributes are applied. Therefore, when performing the same character modification on the same line, the character attribute code is not required for each of the characters, thereby increasing the operability of the character display.

BRIEF DESCRIPTION OF THE DRAWINGS

FIG. 1(*b*) is a diagram showing an address map of a video RAM, which is a constituent of the on-screen display device according to the first embodiment.

FIG. 5(*b*) is a diagram showing an address map of a video RAM, which is a constituent of the on-screen display device according to the second embodiment.

FIG. 9(*b*) is a diagram showing an address map of a video RAM, which is a constituent of the conventional on-screen display device.

DETAILED DESCRIPTION OF THE PREFERRED EMBODIMENTS

Hereinafter, embodiments of the present invention will be described with reference to the drawings. The embodiments shown herein are only exemplary and the present invention is not limited to these embodiments.

[Embodiment 1]

An on-screen display device according to a first embodiment of the present invention will be described.

Figure 1A:
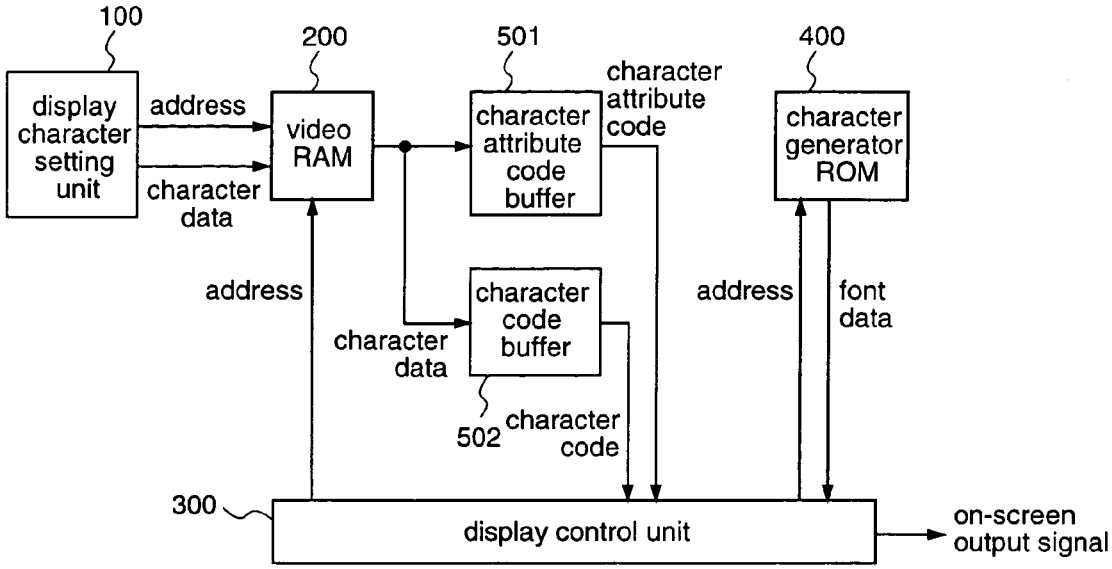
FIG. 1(*a*) is a diagram illustrating a structure of an on-screen display device according to a first or third embodiment of the present invention.
Figure 1B:
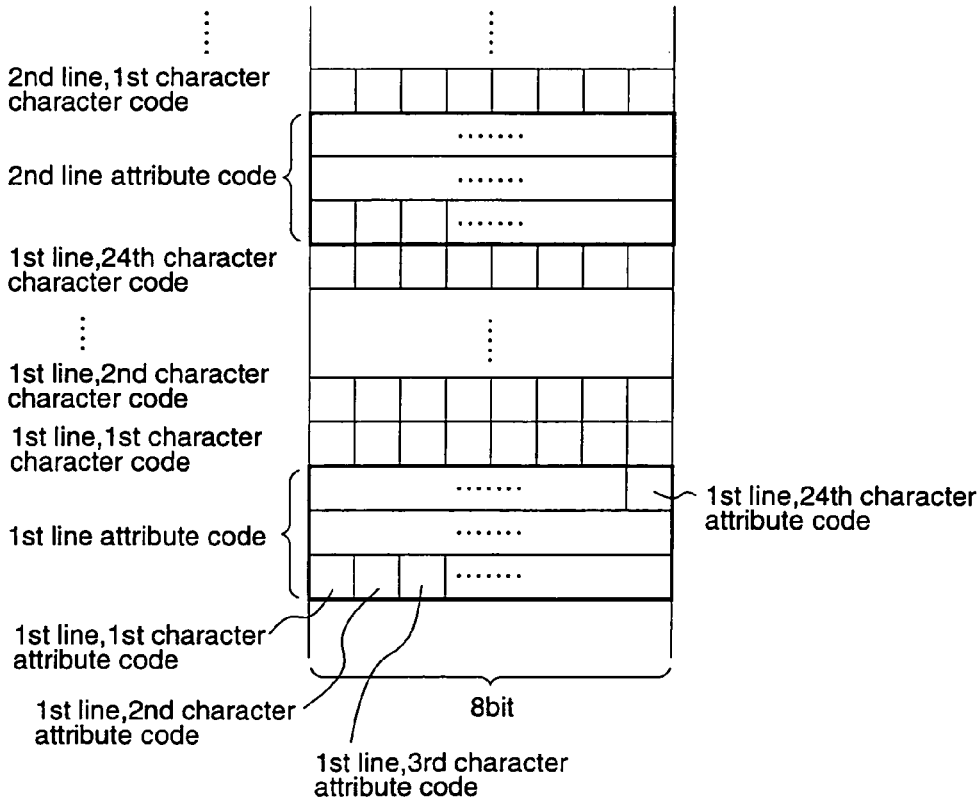

FIG. 1(*a*) is a diagram illustrating a structure of an on-screen display device according to the first embodiment, and FIG. 1(*b*) is a diagram showing an address map of a video RAM 200 according to the first embodiment. In these figures, the same or corresponding components as those in FIGS. 9(*a*) and 9(*b*) are denoted by the same reference numerals.

Character data comprises a character code indicating the type of a character, or a character attribute code indicating modification display of each character and a character code indicating the type of the character. In this first embodiment, character data is composed of 9 bits, 1 bit of which is a character attribute code indicating modification display of a character, such as the color of the display, and 8 bits of which are a character code indicating the type of the character. It is assumed here that the length of data which can be read at one time from the video RAM 200 is 8 bits.

A character attribute code buffer 501 stores a character attribute code included in the character data that is read from the video RAM 200.

A character code buffer 502 stores a character code included in the character data that is read from the video RAM 200.

Figure 2:
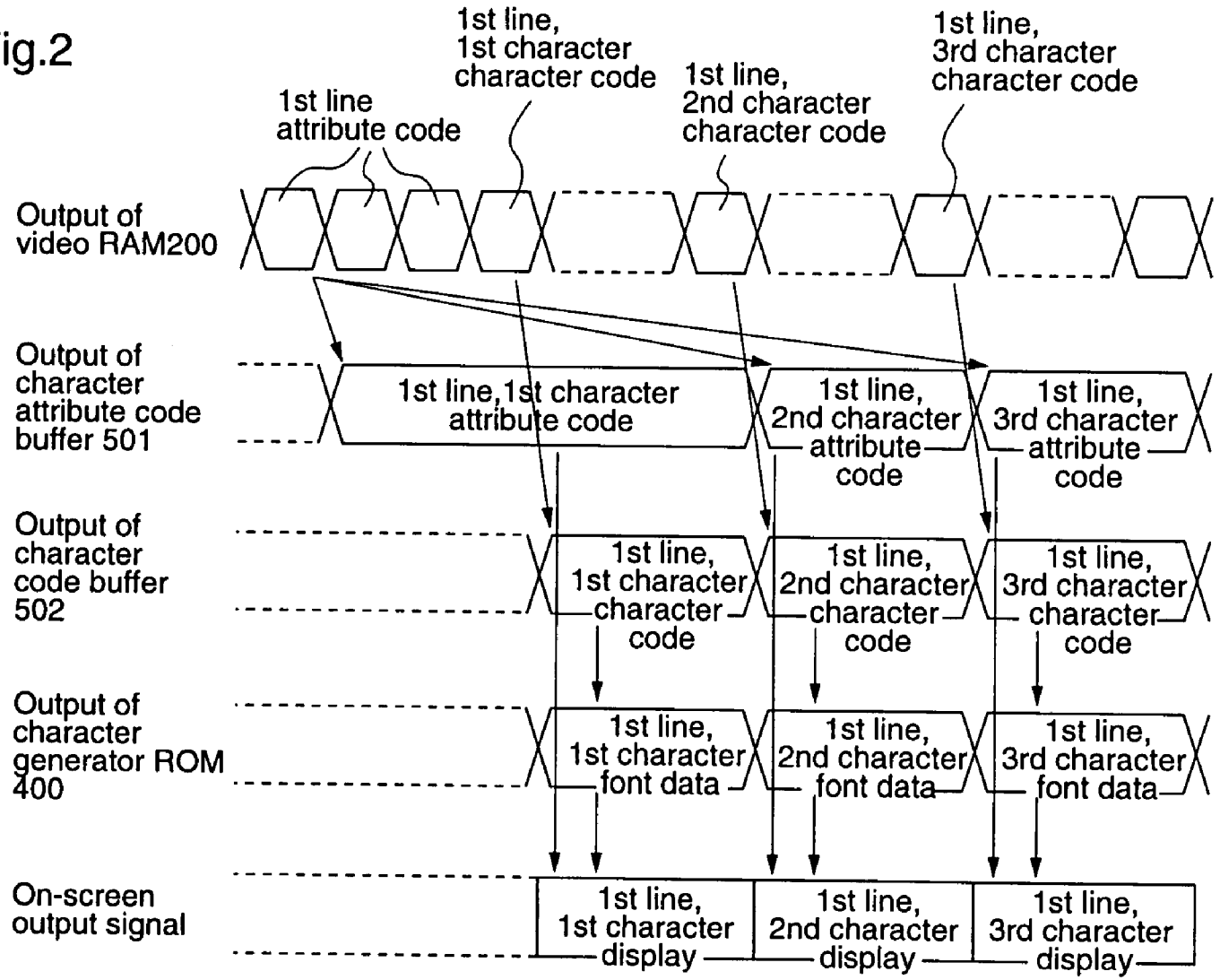
FIG. 2 is a diagram showing timing of accessing of the CPU to the video RAM, which is a constituent of the on-screen display device according to the first embodiment.

The operation of the on-screen display device that is constructed as described above will be described. FIG. 2 is a timing chart showing an operation of the on-screen display device after reading of the character data from the video RAM 200.

First, character data of characters that are to be displayed on the display are written by the display character setting unit 100 at predetermined positions in the video RAM 200. At this time, as shown in FIG. 1(*b*), character attribute codes of several characters are collectively positioned. That is, the display character setting unit 100 positions character attribute codes of several characters in an area, the data of which can be read from the video RAM 200 at one-time access, to write these codes in the consecutive address areas of the video RAM 200.

The display control unit 300 reads the character data that have been written by the display character setting unit 100, from the video RAM 200 at predetermined timing. At this time, the display control unit 300 outputs the character attribute codes corresponding to one line, included in the character data that have been read, to the character attribute code buffer 501, and thereafter successively outputs character codes included in the character data to the character code buffer 502.

The character attribute codes stored in the character attribute code buffer 501 and the character codes stored in the character code buffer 502 are successively outputted to the display control unit 300 in agreement with the display.

The display control unit 300 reads font data that are stored in addresses indicated by the character codes that are outputted from the character code buffer 502, from the character generator ROM 400. Then, the display control unit 300 generates an on-screen output signal on the basis of the font data that are read from the character generator ROM 400 and the character attribute codes that are outputted from the character attribute code buffer 501. Thereby, the desired characters can be displayed on the screen.

As described above, the on-screen display device according to the first embodiment includes the video RAM 200 that holds character data of desired characters that are to be displayed on the display, the display character setting unit 100 which positions the attribute codes included in the data of plural characters that are displayed on the same line in an area of the video RAM 200, the data of which can be read at one-time access, thereby to write these codes in the consecutive address areas of the video RAM 200, the character code buffer 502 that stores the character codes included in the character data that are outputted from the video RAM 200, the character attribute code buffer 501 that stores the attribute codes included in the character data outputted from the video RAM 200, the character generator ROM 400 that creates font data corresponding to the character codes, and the display control unit 300 that reads the character codes included in the character data that are outputted from the video RAM 200, from the character code buffer 502, and generates a desired on-screen output signal on the basis of the font data that are outputted from the character generator ROM 400 and the attribute codes that are outputted from the character attribute code buffer 501. Therefore, even when the bit length of the character data is different from the bit length of data that is accessed in the RAM, it is possible to effectively utilize the video RAM area.

Figure 3:
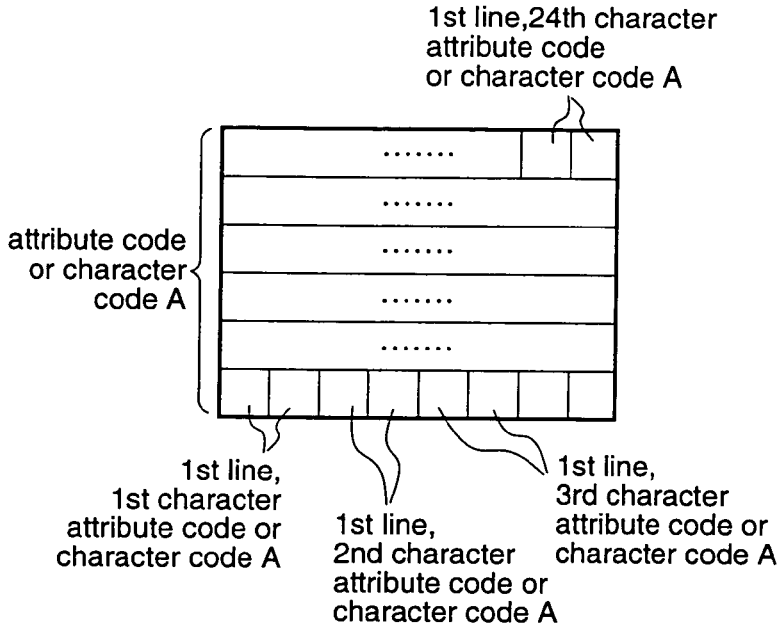
FIG. 3 is a diagram showing an address map of the video RAM according to the first or second embodiment in a case where there are two types of character attributes or characters.
Figure 4:
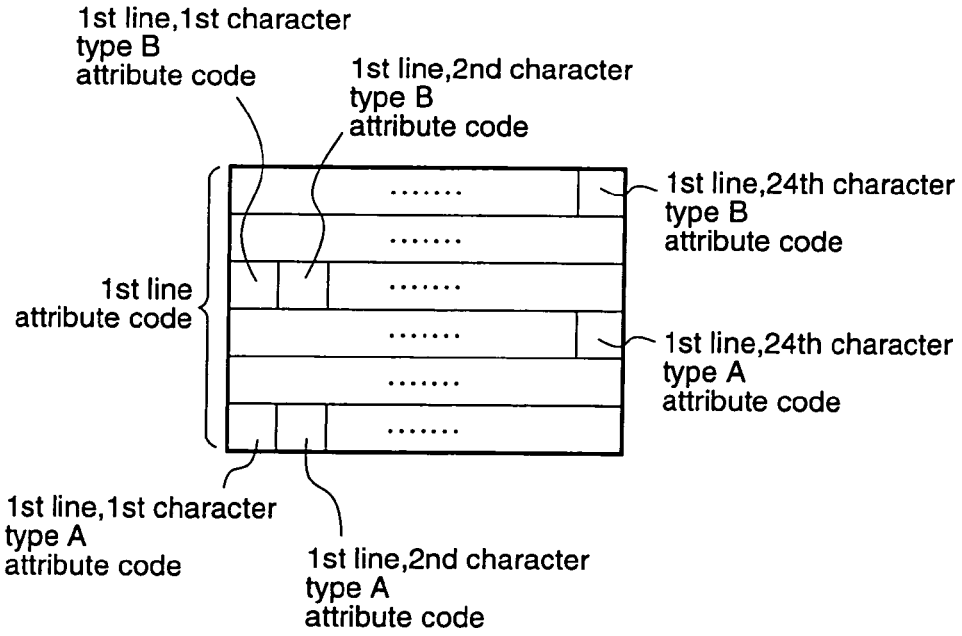
FIG. 4 is a diagram showing an address map of the video RAM according to the first embodiment in a case where there are two types of character attributes, and the codes are grouped by attributes.

In this first embodiment, the character attribute code of one character is composed of 1 bit. However, in a case where the attribute code is composed of plural bits, which can designate plural types of attributes, it is possible to achieve the same effect by positioning the attribute codes collectively in an area of the video RAM 200 as shown in FIG. 3 or 4. Particularly when the attribute codes are grouped by types, for example, type A indicating reverse display and type B indicating button display as shown in FIG. 4, the operability of the device in handling the attributes collectively by type is enhanced.

In addition, according to the first embodiment, the character codes are temporarily stored in the character code buffer 502 and outputted to the display control unit 300 at predetermined timing. However, when the character codes are outputted from the video RAM 200 to the display control unit 300 during a certain period, it is unnecessary to use the character code buffer 502, resulting in reduction of the circuit scale.

In the first embodiment, the description has been given of the case where the total number of bits of the character code and the attribute code are 9 bits, and 8 bits are read at one time from the video RAM 200, and only the attribute codes corresponding to one line are collectively positioned in the video RAM 200. However, the same effect is also achieved by positioning codes each being composed of a number of bits as many as the remainder that is obtained by dividing the total number of bits of the character code and the attribute code by the number of bits that can be read at one time from the video RAM 200, collectively by one line in the video RAM 200. More specifically, since in this first embodiment, the number of bits that can be read from the video RAM at one time is a multiple of 8, it is possible to write codes each being composed of the number of bits as many as the remainder that is obtained by dividing the total number of bits by 8, collectively by one line, in the video RAM 200.

Further, in this first embodiment, the outputs from the video RAM 200 corresponding to one line are collectively stored in the character attribute code buffer 501. However, when the amount of data that can be read from the video RAM 200 at one time are stored each time in the character attribute code buffer 501 without collectively storing the codes of one line, and when the next data are successively read from the video RAM 200 and stored after using the data that are stored in the character attribute code buffer 501, the size of data that are stored in the character attribute code buffer 501 can be further reduced, which leads to miniaturization of the circuit scale.

[Embodiment 2]

An on-screen display device according to a second embodiment of the present invention will be described.

Figure 5A:
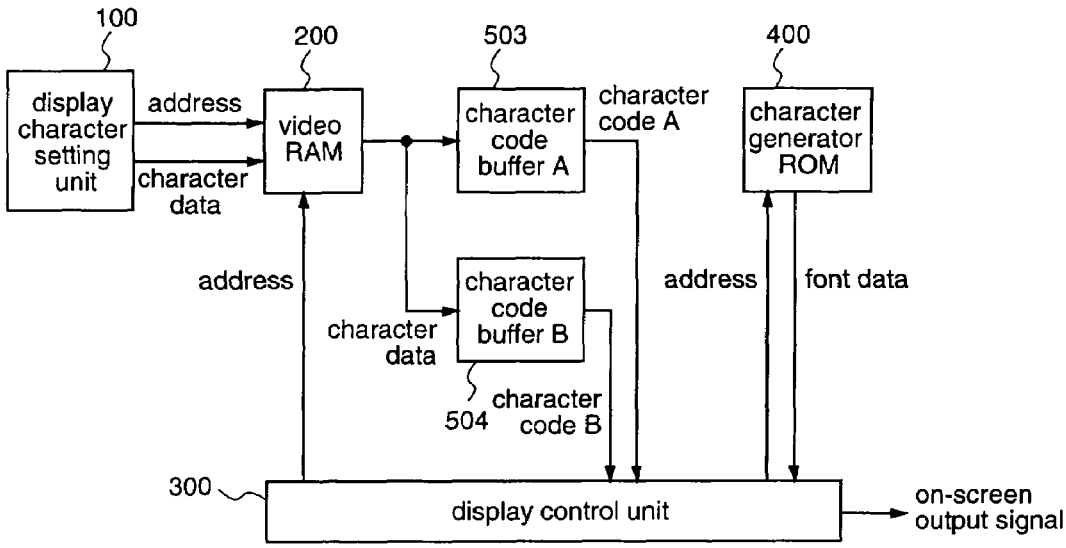
FIG. 5(*a*) is a diagram illustrating a structure of an on-screen display device according to a second embodiment of the present invention.
Figure 5B:
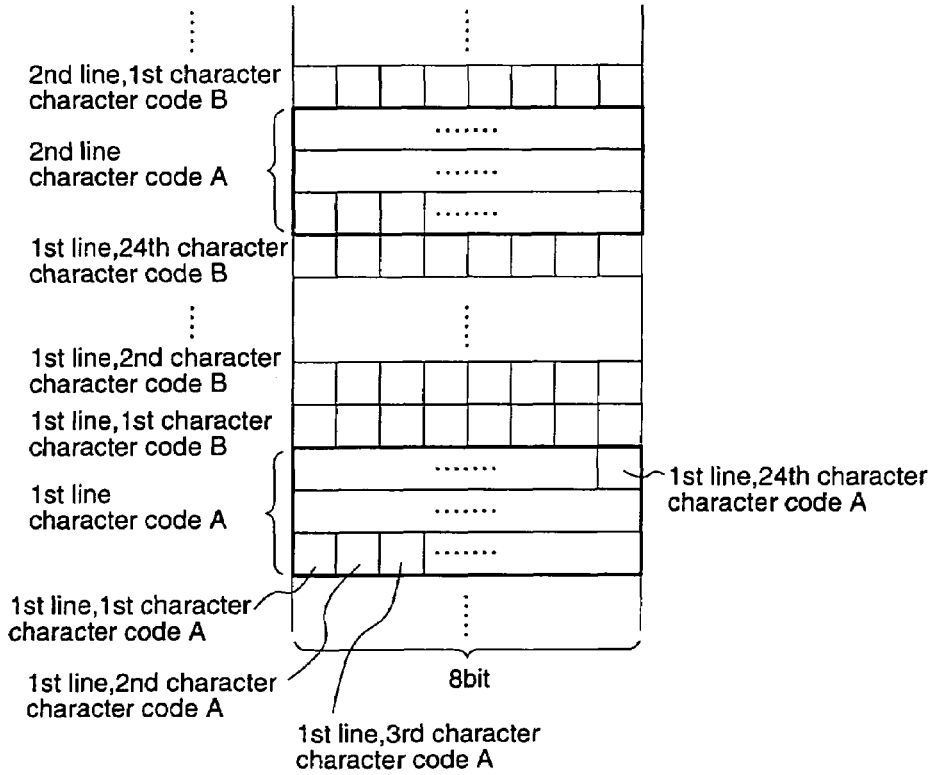
Figure 9A:
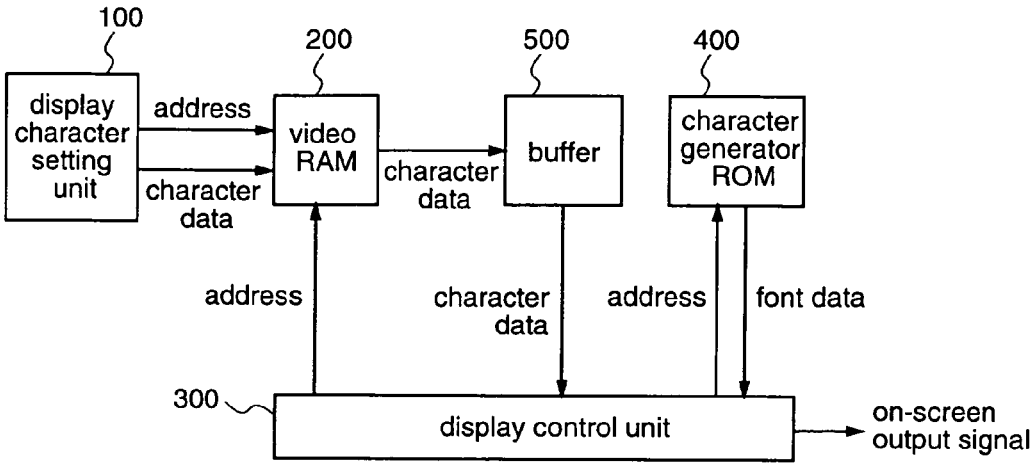
Fig.9(a) Prior Art
FIG. 9(*a*) is a diagram illustrating a structure of a conventional on-screen display device.
Figure 9B:
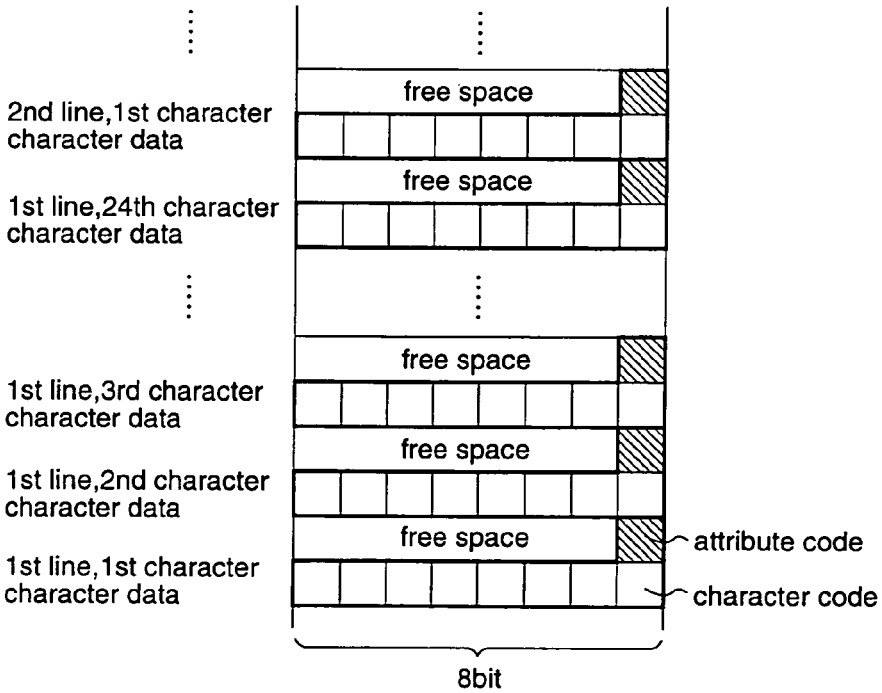
Fig.9(b) Prior Art

FIG. 5(*a*) is a diagram illustrating a structure of an on-screen display device according to the second embodiment, and FIG. 5(*b*) is a diagram showing an address map of the video RAM 200 according to the second embodiment. In these figures, the same or corresponding components as those in FIG. 9 are denoted by the same reference numerals.

Character data of one character is composed of R bits (R is an integer that is equal to or larger than 2), and comprises a character code indicating the type of a character, or a character attribute code indicating modification display of each character and a character code indicating the type of the character. In this second embodiment, it is assumed that character data is composed of 9 bits, the data comprises a 9-bit character code indicating the type of the character, and the length of data that can be read from the video RAM 200 at one time is 8 bits.

A character code buffer A 503 reads r bits ($1 \leqq r < 9$) of respective m pieces of character data ($2 \leqq m \leqq M$), selected from among M pieces of character data ($2 \leqq M$) corresponding to characters that are displayed on the same line, i.e., reads m×r bits in total (character code A) at one-time access from the video RAM 200, and stores the read data.

A character code buffer B 504 stores the remaining (R−r) bits of the respective character data (character code B).

Figure 6:
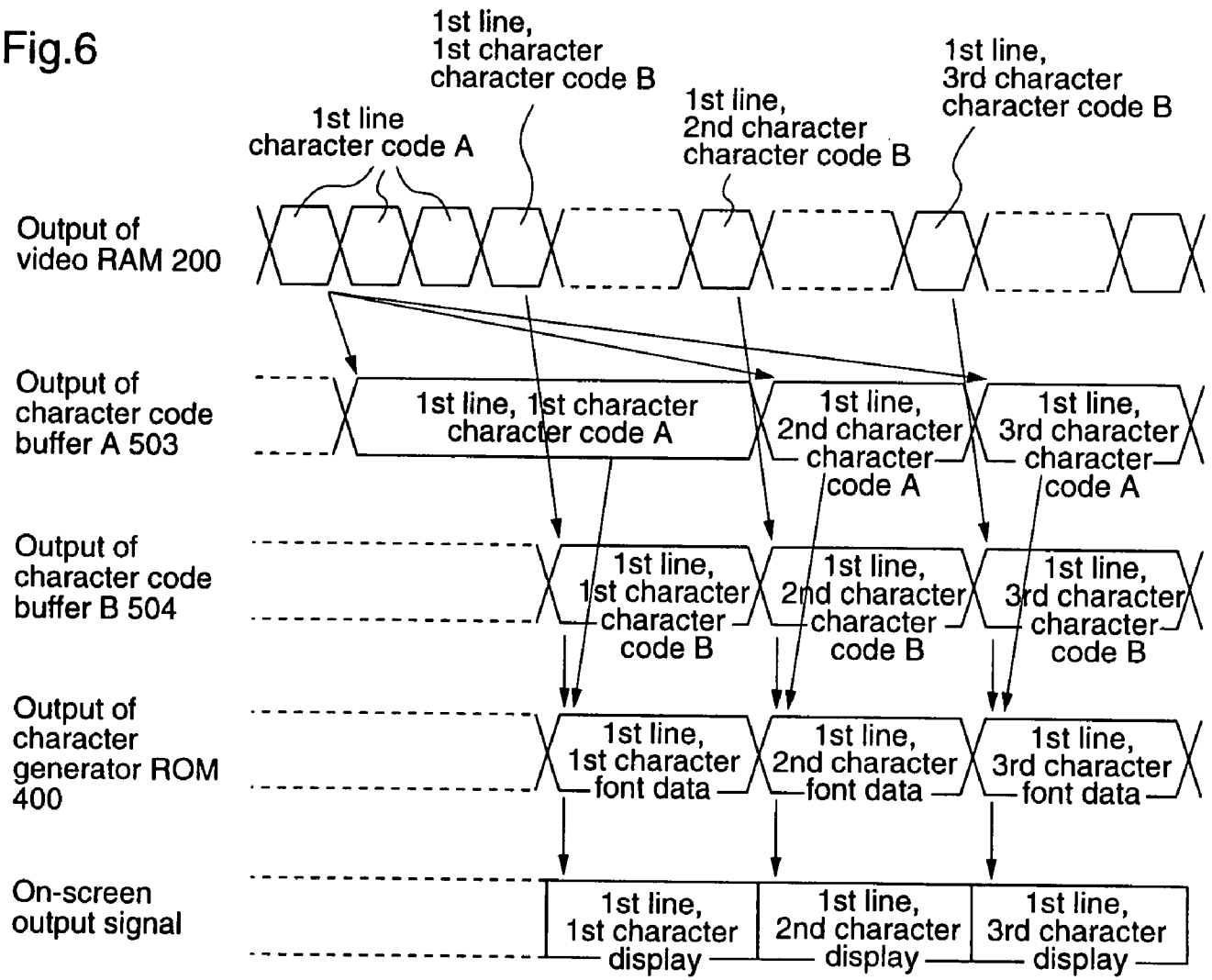
FIG. 6 is a diagram showing timing of accessing of the CPU to the video RAM that is a constituent of the on-screen display device according to the second embodiment.

The operation of the on-screen display device that is constituted as described above will be described. FIG. 6 is a timing chart showing an operation of the on-screen display device after reading of the character data from the video RAM 200.

First, character data of characters that are to be displayed on the display are written by the display character setting unit 100 at predetermined positions in the video RAM 200. At this time, it is assumed that the highest-order 1 bit among the 9-bit character code is a character code A, lower-order 8 bits are a character code B, and the character codes A of several characters are collectively positioned as shown in FIG. 5(*b*). That is, the display character setting unit 100 positions the character codes corresponding to several characters in an area, the codes of which can be read from the video RAM 200 at one-time access, thereby to write the codes in the area of consecutive addresses in the video RAM 200.

The display control unit 300 reads the character data that have been written by the display character setting unit 100 from the video RAM 200 at predetermined timing. At this time, the display control unit 300 outputs data of the character codes A corresponding to one line included in the character data that have been read, to the character code buffer A 503, and then outputs data of the character codes B included in the character data successively to the character code buffer B 504.

The character codes A stored in the character code buffer A 503 and the character codes B stored in the character code buffer B 504 are outputted to the display control unit 300 successively in agreement with the display.

The display control unit 300 reads font data that are stored at addresses that are indicated by the character codes A and B outputted from the character code buffer A 503 and the character code buffer B 504, from the character generator ROM 400. Then, an on-screen output signal is generated on the basis of the font data read from the character generator ROM 400. Thereby, on-screen display of the desired characters can be achieved.

As described above, the on-screen display device according to the second embodiment includes the video RAM 200 that holds character data of desired characters which are to be displayed on the display, the display character setting unit 100 that writes the character data at predetermined positions in the video RAM 200, the character code buffer A 503 that reads r bits ($1 \leqq r < R$) of respective m pieces ($2 \leqq m \leqq M$) of character data (character codes A), selected from among M pieces ($2 \leqq M$) of the character data corresponding to characters that are to be displayed on the same line, at one-time access from the video RAM 200 and stores the data, the character code buffer B 504 that stores the character codes B which is composed of the remaining (R−r) bits of the respective m pieces of character data, the character generator ROM 400 that creates font data corresponding to the character codes included in the character data that are outputted from the character code buffer A 503 and the character code buffer B 504, and the display control unit 300 that generates a desired on-screen output signal on the basis of the font data that are outputted from the character generator ROM 400. Therefore, even when the bit length of the character data is different from the bit length of data that is accessed in the RAM, it is possible to effectively utilize the area in the video RAM 200.

In this second embodiment, the character code A of one character is composed of 1 bit. However, when the character code A is composed of plural bits, which can designate plural types of characters, it is possible to achieve the same effect by positioning only the character codes of the same type in an area of the video RAM 200, the data of which can be read at one-time access as shown in FIG. 3.

Further, in the second embodiment, when the total number of bits of the character code A and the character code B is 9 bits, and data that can be read from the video RAM 200 at one time is 8 bits, only the character codes A corresponding to one line are collectively positioned in the video RAM 200. However, the above-mentioned effect is also achieved by positioning codes of the number of bits as many as the remainder that is obtained by dividing the total number of bits of the character code A and the character code B by the number of bits of data that can be read from the video RAM 200 at one time (8 bits in this embodiment), collectively by one line in the video RAM 200.

In this second embodiment, the outputs from the video RAM 200 corresponding to one line are collectively stored in the character code buffer A 503. However, when the amount of data that can be read from the video RAM 200 at one time are stored each time in the character code buffer A 503 without collectively storing the outputs corresponding to one line, and when the next data are successively outputted from the video RAM 200 and stored after the data stored in the character code buffer A 503 have been employed, it is possible to further reduce the size of data that are stored in the character code buffer A 503, which leads to reduction in the circuit scale.

[Embodiment 3]

An on-screen display device according to a third embodiment of the present invention will be described. As a diagram illustrating a structure of the on-screen display device according to the third embodiment, FIG. 1(*a*) that has been used in the first embodiment is utilized. Components having the same function as those in the first embodiment are not described here.

Figure 7:
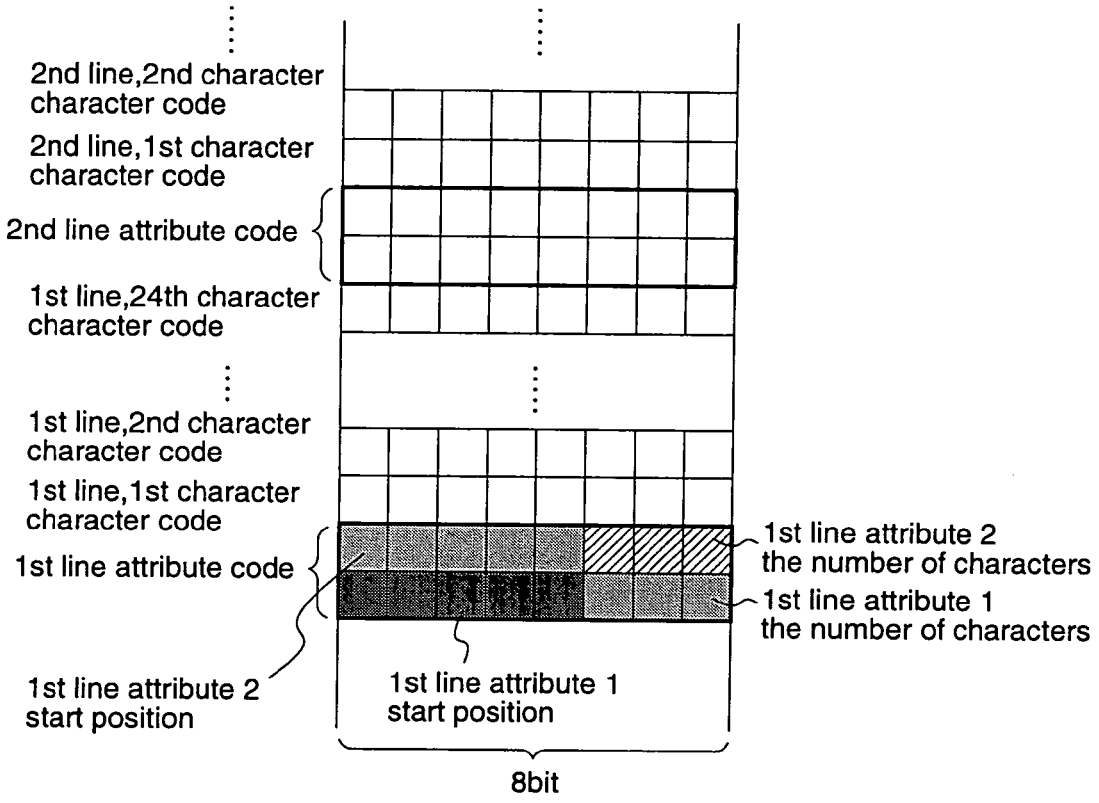
FIG. 7 is a diagram showing an address map of a video RAM, which is a constituent of an on-screen display device according to a third embodiment of the present invention.

FIG. 7 is a diagram showing an address map of the video RAM 200 according to the third embodiment.

Character data comprises a character code indicating the type of a character, or a character attribute code indicating modification display of each character and a character code indicating the type of the character. According to the third embodiment, it is assumed that a character code corresponding to one character is composed of 8 bits, a character attribute code corresponding to one line is composed of 16 bits, and the length of data that can be read from the video RAM 200 at one time is 8 bits. It is further assumed that up to seven consecutive characters at two positions can be subjected to character attribution in each line.

The operation of the on-screen display device that is constructed as described above will be described.

Initially, character data of characters that are to be displayed on the display are written by the display character setting unit 100 at predetermined positions in the video RAM 200. At this time, as shown in FIG. 7, the character attribute codes include a code indicating a start position of desired character modification and a code indicating the number of characters that are subjected to the character modification.

The display control unit 300 reads the character data that have been written by the display character setting unit 100 at predetermined timing from the video RAM 200. At this time, the attribute codes and the character codes included in the character data that have been read are stored in the character attribute code buffer 501 and the character code buffer 502, respectively.

The character attribute codes stored in the character attribute code buffer 501 and the character codes stored in the character code buffer 502 are outputted to the display control unit 300 successively in agreement with the display.

The display control unit 300 reads font data that are stored in the character generator ROM 400 at addresses indicated by the character codes that are outputted from the character code buffer 502. Then, the display control unit performs character modification to the font data that have been read from the character generator ROM 400 on the basis of position information indicated by the character attribute codes outputted from the character attribute code buffer 501, thereby generating an on-screen output signal.

In this third embodiment, the description has been given of the structure in which the character attribute code for one position of the character modification is composed of 8 bits, and attributes of up to seven consecutive characters can be designated. However, it is possible to use a structure that enables to designate both of a start position and an end position of the attribute, or a structure in which the number of bits of the attribute code for one position can be changed.

Further, in the third embodiment, the description has been given of the case where the character modification is performed at two positions per line, but alternatively it is possible to perform the character modification at one position per line.

As described above, the on-screen display device according to the third embodiment includes the video RAM 200 that holds character data of desired characters that are to be displayed on the display, the display character setting unit 100 that writes the character data at predetermined positions in the video RAM 200, the character code buffer 502 that stores character codes included in the character data that are outputted from the video RAM 200, the character attribute code buffer 501 that stores attribute codes included in the character data that are outputted from the video RAM 200, the character generator ROM 400 that create font data corresponding to the character code, and the display control unit 300 that reads the character codes included in the character data that are outputted from the video RAM 200, from the character code buffer 502, and generates a desired on-screen output signal on the basis of the font data that are outputted from the character generator ROM 400 and the attribute codes that are outputted from the character attribute code buffer 501. Therefore, even when the bit length of the character data is different from the bit length of data that is accessed in the RAM, it is possible to effectively utilize the video RAM area.

Further, according to this third embodiment, since the attribute codes included in the character data which are outputted from the video RAM 200 are those indicating the position of starting application of the attributes and the position of completing the application of the attributes or the number of characters to which the attributes are applied, the character attribute is not necessarily needed for each character in performing the same character modification on the same line, and thereby the operability of the character display is increased.

Figure 8:
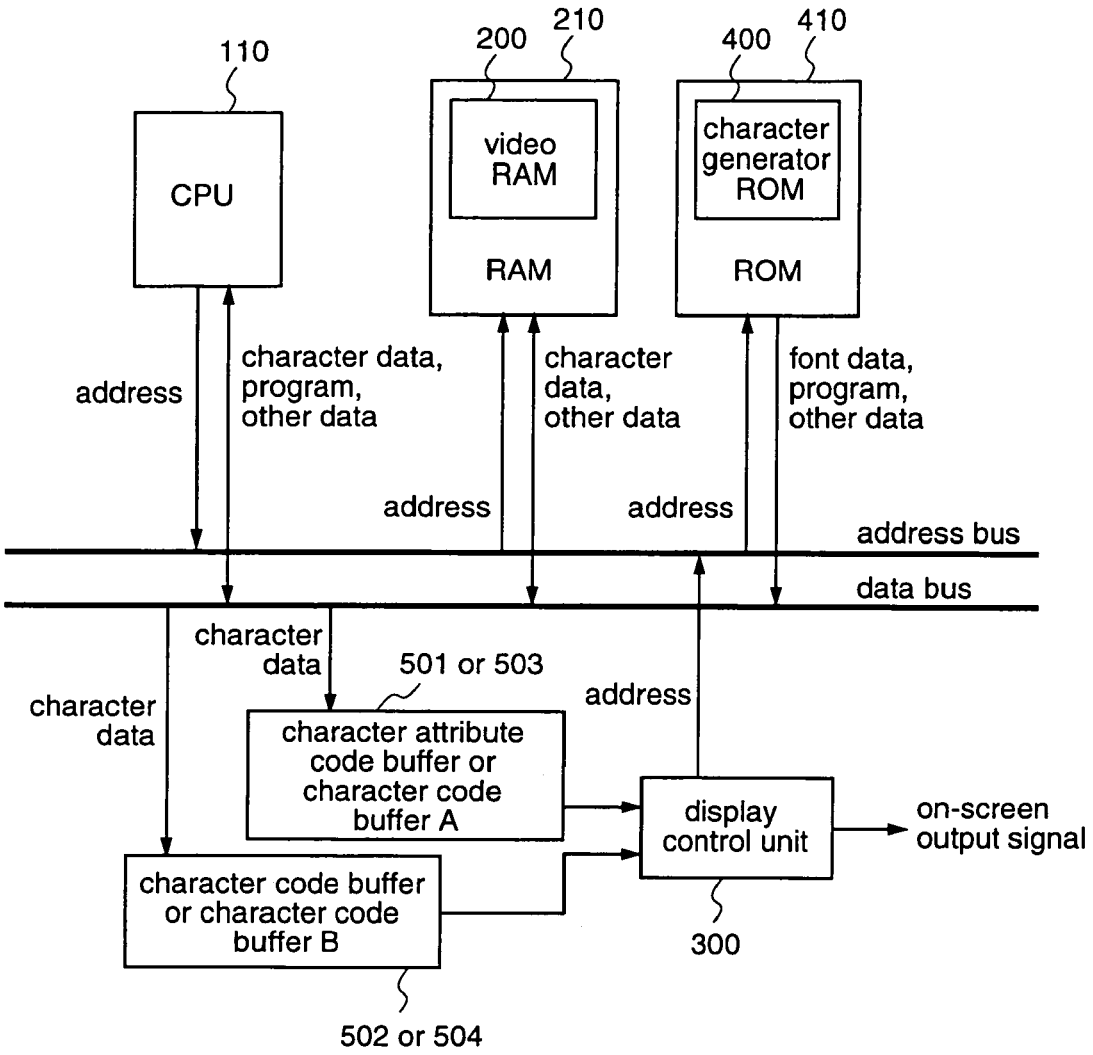
FIG. 8 is a block diagram illustrating a case where the video RAM and a character generator ROM according to any of the first to third embodiments are utilized also as a RAM and a ROM of the CPU, respectively.

In the first to third embodiments, the display character setting unit 100 can be implemented by a CPU (central processing unit). Particularly in a structure as shown in FIG. 8 where the display character setting unit 100 is a CPU 110, the video RAM 200 is included in a RAM 210, and the character generator ROM 400 is included in a ROM 410, the bit length of character data which are read or written in the video RAM 200 can be matched to the bit length of data in the RAM 210 when reading/writing from/to the video RAM 200 or the character generator ROM 400 is performed via a common address bus and a common data bus, thereby realizing an efficient size of the video RAM.

Further, in the first to the third embodiments, it is possible to display 24 characters of 12 lines on one screen. However, the same effect is achieved in another structure for displaying different number of characters of different number of lines.

What is claimed is:

1. An on-screen display device for displaying desired characters on a display, character data of one character being composed of R bits (R is an integer that is equal to or larger than 2), and the character data comprising character codes that indicate types of the characters, or attribute codes that indicate modification display of the respective characters and character codes that indicate types of the characters, including:

a video RAM that holds the character data of the desired characters that are to be displayed on the display;

a display character setting unit for writing the character data at predetermined positions in the video RAM;

a first buffer that reads r bits ($1 \leqq r < R$) of respective m pieces ($2 \leqq m \leqq M$) of the character data selected from among M pieces ($2 \leqq M$) of the character data corresponding to characters that are displayed on one line, from the video RAM at one-time access, and stores the read data;

a second buffer that stores remaining (R−r) bits of the respective m pieces of the character data;

a character generator ROM for creating font data corresponding to the character codes included in the character data that are outputted from the first and second buffers; and a display control unit for reading the font data from the character generator ROM and generating a desired on-screen output signal on the basis of the font data.

2. The on-screen display device of claim 1 wherein the remaining (R−r) bits of the character data that are stored in the second buffer are formed in a bit-size that is a multiple of 8.

3. The on-screen display device of claim 1 wherein the display character setting unit positions r bits of the respective m pieces of the character data selected from among the M pieces of the character data corresponding to characters that are displayed on one line, in an area of the video RAM from which the data can be read at one-time access, so as to write the r bits of the respective m pieces of the character data in consecutive address areas of the video RAM.

4. The on-screen display device of claim 1 wherein the character data that are stored in the first buffer are composed of a part or all of the attribute codes.

5. The on-screen display device of claim 1 wherein the character data that are stored in the first buffer are composed of only a part of the character codes.

6. The on-screen display device of claim 4 wherein the attribute codes that are stored in the first buffer are codes indicating two types of attributes, and only the attribute codes indicating the same type of attribute are located in an area of the video RAM from which data can be read at one-time access.

7. The on-screen display device of claim 5 wherein as for the part of the character codes that are stored in the first buffer, respective bits of the part of the character codes relating to the same character are located only in an area of the video RAM from which data can be read at one-time access.

8. An on-screen display device for displaying desired characters on a display, data of the characters comprising character codes that indicate types of the characters, or attribute codes that indicate modification display of the characters and character codes that indicate types of the characters, said device comprising:

a video RAM that holds the character data of the desired characters that are to be displayed on the display;

a display character setting unit for writing the character data at predetermined positions in the video RAM;

a character code buffer for storing the character codes included in the character data that are outputted from the video RAM;

an attribute code buffer for storing the attribute codes included in the character data that are outputted from the video RAM;

a character generator ROM for creating font data corresponding to the character codes; and a display control unit for reading the character codes included in the character data that are outputted from the video RAM, from the character code buffer, and generating a desired on-screen output signal on the basis of the font data that are outputted from the character generator ROM and the attribute codes outputted from the attribute code buffer, wherein the attribute codes included in the character data that are outputted from the video RAM indicate a start position of application of attributes, and an end position of the application of attributes or the number of characters to which the attributes are applied.

* * * * *